US008966915B2

(12) United States Patent
Takeuchi et al.

(10) Patent No.: US 8,966,915 B2
(45) Date of Patent: Mar. 3, 2015

(54) AIR-CONDITIONING APPARATUS UTILIZING COMPRESSOR PREHEATING

(75) Inventors: Katsuya Takeuchi, Tokyo (JP); Hirokuni Shiba, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 454 days.

(21) Appl. No.: 13/368,540

(22) Filed: Feb. 8, 2012

(65) Prior Publication Data

US 2012/0227430 A1 Sep. 13, 2012

(30) Foreign Application Priority Data

Mar. 9, 2011 (JP) ..... 2011-51498

(51) Int. Cl.
*F25B 43/02* (2006.01)
*F25B 49/02* (2006.01)
*F25B 49/00* (2006.01)

(52) U.S. Cl.
CPC ..... *F25B 49/02* (2013.01); *F25B 49/00* (2013.01); *F25B 2313/0315* (2013.01); *F25B 2400/08* (2013.01); *F25B 2700/2115* (2013.01)
USPC ..... 62/84; 62/192; 62/193; 62/468

(58) Field of Classification Search
CPC ..... F25B 49/02; F25B 2700/03–2700/04; F25B 2700/2115; H02P 29/005
USPC ..... 62/84, 192, 193, 468; 417/13
See application file for complete search history.

(56) References Cited

U.S. PATENT DOCUMENTS

2012/0023984 A1 2/2012 Sakai et al.

FOREIGN PATENT DOCUMENTS

| | | | |
|---|---|---|---|
| CN | 101408485 | A | 4/2009 |
| EP | 0 426 152 | A1 | 5/1991 |
| JP | 62-180 | U | 1/1987 |
| JP | 06-018102 | A | 1/1994 |
| JP | 11-072274 | A | 3/1999 |
| JP | 2000-161210 | A | 6/2000 |
| JP | 2002-317785 | A | 10/2002 |
| JP | 2005-180753 | A | 7/2005 |

(Continued)

OTHER PUBLICATIONS

JP 2008-064447. Published Mar. 21, 2008 (English Translation).*

(Continued)

*Primary Examiner* — Jonathan Bradford
(74) *Attorney, Agent, or Firm* — Buchanan Ingersoll & Rooney PC

(57) ABSTRACT

An air-conditioning apparatus includes an outdoor air temperature sensor detecting an outdoor temperature; a compressor temperature sensor detecting a temperature of an outer wall of a compressor; a liquid-level and concentration detection sensor detecting a liquid surface level in the compressor and a concentration of a lubricant oil in a liquid in the compressor; an electric heater heating the compressor; and a controller that carries out preheating to the compressor by driving the electric heater when a detection value of the outdoor air temperature sensor is higher than or equal to a detection value of the compressor temperature sensor and, further, when the liquid surface level detected by the liquid-level and concentration detection sensor is higher than or equal to a predetermined level and the concentration of the lubricant oil in the liquid is lower than a preset minimum required concentration.

9 Claims, 2 Drawing Sheets

(56) References Cited

FOREIGN PATENT DOCUMENTS

| | | | |
|---|---|---|---|
| JP | 2008-64447 | A | 3/2008 |
| WO | 2010/103734 | A1 | 9/2010 |

OTHER PUBLICATIONS

Extended European Search Report dated Apr. 7, 2014, issued by the European Patent Office in corresponding European Application No. 12001243.0. (6 pages).

Office Action (Notice of Reasons for Refusal) issued on Jan. 28, 2014, by the Japanese Patent Office in corresponding Japanese Patent Application No. 2011-051498, and an English Translation of the Office Action. (5 pages).

Office Action (Notification of the First Office Action) issued on Jan. 30, 2014, by the Chinese Patent Office in corresponding Chinese Patent Application No. 201210060180.3, and an English Translation of the Office Action. (11 pages).

Japanese Office Action dated Jun. 3, 2014, issued by the Japanese Patent Office in corresponding Japanese Patent Application No. 2011-051498, and English language translation of Office Action. (2 pages).

* cited by examiner

AIR-CONDITIONING APPARATUS UTILIZING COMPRESSOR PREHEATING

TECHNICAL FIELD

The present disclosure relates to an air-conditioning apparatus, in particular, relates to control of preventing refrigerant from stagnating in a compressor.

BACKGROUND ART

An air-conditioning apparatus often has an outdoor unit disposed outdoors, and there is a case in which refrigerant stagnates in a compressor while the outdoor unit is suspended. For example, in winter when the outdoor air temperature is low, the ambient temperature of the outdoor unit disposed outdoors becomes lower compared with the ambient temperature of the indoor unit disposed indoors. In such a case, a pressure difference may occur between the refrigerant circuit of the indoor unit side and the refrigerant circuit of the outdoor unit side and may result in stagnation of refrigerant on the outdoor unit side with lower pressure. In particular, when refrigerant stagnates in the compressor disposed in the outdoor unit, the refrigerant dissolves into the lubricant oil and concentration of the lubricant oil decreases. This creates a possibility of failure attributed to poor lubrication in the compressor when, at a startup of the air-conditioning apparatus, the lubricant oil flows out of the compressor with the refrigerant.

Hitherto, to attend to the above problem, a method has been adopted in which a compressor is heated to prevent stagnation of refrigerant in the compressor. However, refrigerant does not always stagnate in the compressor while the air-conditioning apparatus is suspended. Thus, viewed from an energy saving perspective, it is preferable that the compressor is heated (preheated) only after a refrigerant stagnating state has been determined by some kind of method. Accordingly, in Patent Literature 1, a method of preheating a compressor is disclosed in which an outdoor unit is provided with an outdoor air temperature sensor and with a temperature sensor of the outer wall of the compressor, each sensor determining whether the inside of the compressor is in a refrigerant stagnating state by using its detection value, and when determined that the compressor is in a refrigerant stagnating state, a motor of the compressor is energized in an open phase state (applying alternating current with a missing phase to the motor so that the motor does not rotate, thus making a coil generate heat), for example.

Further, in Patent Literature 2, a method of preheating a compressor is disclosed in which a compressor is provided with a gas-liquid determination sensor, and when the gas-liquid determination sensor detects that a liquid refrigerant has stagnated more than or equal to a certain liquid surface level in the compressor, a crankcase heater provided in the outer circumference of the compressor is energized.

CITATION LIST

Patent Literature

Patent Literature 1: Japanese Unexamined Patent Application Publication No. 2008-64447 (page 18, FIG. 3)

Patent Literature 2: Japanese Unexamined Utility Model Registration Application Publication No. 62-180 (FIG. 1)

SUMMARY OF INVENTION

Technical Problem

In Patent Literature 1, although whether the compressor is in a refrigerant stagnating state or not is determined by the outdoor air temperature and the temperature of the outer wall of the compressor, determination of whether the actual stagnating amount has reached a level that causes failure of the compressor is not made. Accordingly, there are cases in which energization is carried out even when the preheating is not actually required, and electric power is wastefully consumed.

Furthermore, in Patent Literature 2, the gas-liquid determination sensor directly detects the rise of the liquid surface level of the liquid refrigerant in the compressor and checks the actual amount of the liquid refrigerant that is stagnated in the compressor. However, whether the concentration of the lubricant oil in the liquid refrigerant is high or low is not determined. It is when the concentration of the lubricant oil is low, which is caused by the stagnation of the refrigerant, that the compressor is lead to fail, and, thus, even if the liquid surface level is high, if the concentration of the lubricant oil is high, there will be not much adverse effect to the compressor. During an operation of the air-conditioning apparatus, since the lubricant oil travels in the refrigerant circuit with the refrigerant and resides in a heat exchanger and in extension pipings, the amount of lubricant oil remaining in the compressor changes in accordance with the stopping timing of the air-conditioning apparatus. Accordingly, in the method of merely detecting the liquid surface level with the gas-liquid determination sensor, there has been a problematic case in which the preheating is carried out even when there is a sufficient amount of lubricant oil with high concentration in the compressor.

The present disclosure has been made to overcome the above problems, and an object thereof is to provide an air-conditioning apparatus that is capable of reducing power consumption by eliminating unneeded preheating by determining whether preheating is needed or not taking into account, as well as other factors, the concentration of the lubricant oil in the compressor.

Solution to Problem

An air-conditioning apparatus according to the present disclosure includes an outdoor air temperature detection device detecting an outdoor temperature; a compressor-outer-wall temperature detection device detecting a temperature of a compressor outer-wall; a liquid-level and concentration detection device detecting a liquid surface level in a compressor and a concentration of a lubricant oil in a liquid in the compressor; a heating device heating the compressor; and a controller that carries out preheating to the compressor by driving the heating device when a detection value of the outdoor air temperature detection device is higher than or equal to a detection value of the compressor-outer-wall temperature detection device and, further, when the liquid surface level detected by the liquid-level and concentration detection device is higher than or equal to a predetermined level and the concentration of the lubricant oil in the liquid in the compressor is lower than a preset minimum required concentration.

Advantageous Effects of Invention

According to the present disclosure, preheating to the compressor is carried out when the liquid surface in the compressor rises higher than or equal to a predetermined level and when the concentration of the lubricant oil in the compressor is lower than the minimum required concentration. Thus, even when the liquid surface is higher than or equal to a predetermined level, preheating when the concentration of the lubricant oil in the compressor is sufficient can be eliminated and unneeded power consumption can be reduced.

DESCRIPTION OF EMBODIMENTS

Figure 1:
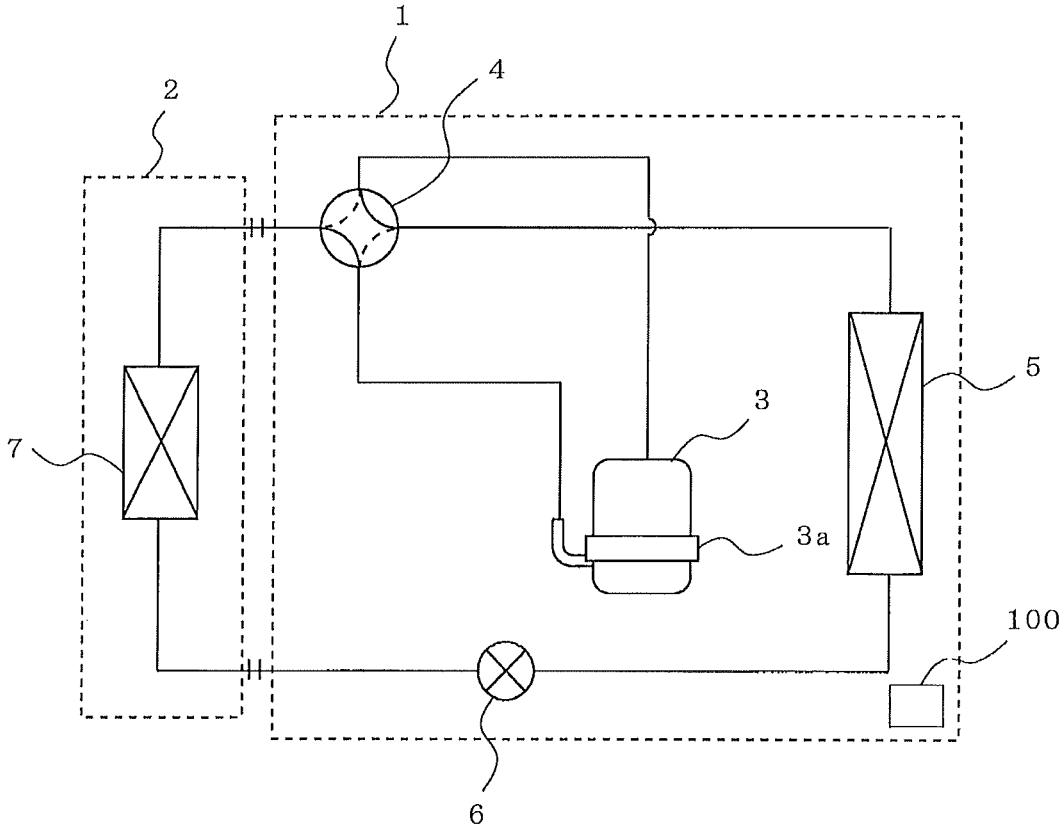
FIG. 1 is a refrigerant circuit diagram of a general air-conditioning apparatus according to an embodiment of the disclosure.

FIG. 1 is a refrigerant circuit diagram of a general air-conditioning apparatus according to an embodiment of the disclosure.

The air-conditioning apparatus is provided with an outdoor unit 1 disposed outdoors and an indoor unit 2 disposed indoors, which are connected with an extension piping. The outdoor unit is provided with a compressor 3, a four-way valve 4, an outdoor heat exchanger 5, and an expansion valve 6 and the indoor unit 2 is provided with an indoor heat exchanger 7, which are circularly connected constituting a refrigerant circuit in which a refrigerant circulates. The air-conditioning apparatus constituted as above is capable of carrying out a heating operation or a cooling operation by switching the four-way valve. Further, the compressor 3 is provided with an electric heater 3*a* that serves as a heating device to heat the refrigerant stagnating in the compressor 3. The heating device is not limited to the electric heater 3*a*, and a motor (not illustrated) for driving the compressor may be charged with a restraint current (applying low voltage which makes a motor winding generate heat but does not make the compressor rotate) and the heat generated by the motor winding may be used to heat the refrigerant.

The air-conditioning apparatus is further provided with a controller 100 that controls the entire air-conditioning apparatus. It should be noted that in FIG. 1, the configuration in which the controller 100 is only provided in the outdoor unit 1 is illustrated, but an indoor control device that has a part of the function of the controller 100 may be provided in the indoor unit 2, and the configuration may be such that the controller 100 and the indoor control device carry out cooperative processing by communicating data therebetween.

Figure 2:
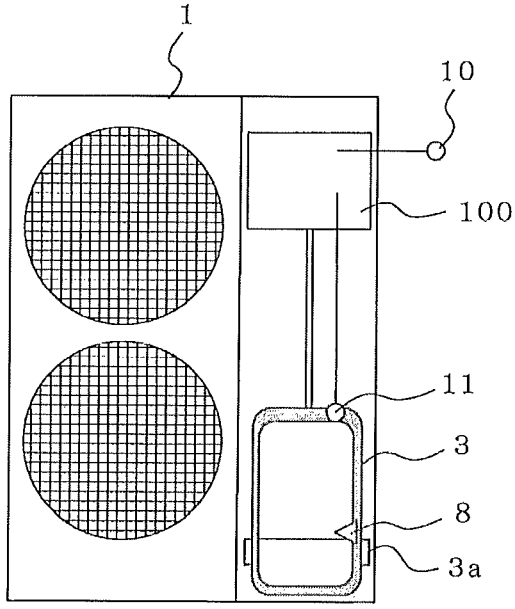
FIG. 2 is a schematic configuration diagram illustrating a configuration of an outdoor unit of an air-conditioning apparatus according to an embodiment of the disclosure.

FIG. 2 is a schematic configuration diagram illustrating a configuration of an outdoor unit of an air-conditioning apparatus according to an embodiment of the disclosure. In FIG. 2, same parts as FIG. 1 will be referred to with the same reference numerals.

A liquid-level and concentration detection sensor 8 that detects the liquid surface level and the concentration of the lubricant oil in the liquid refrigerant that is stagnating in the compressor 3 is provided in the compressor 3. The liquid-level and concentration detection sensor 8 is capable of simultaneously carrying out both liquid surface detection and concentration detection, and the mounting of the sensor is, considering the reliability and cost accompanying the mounting process, to be performed to only a single portion in the compressor 3. Note that the mounting position of the liquid-level and concentration detection sensor 8 is at a level where a minimum required concentration can be obtained even when the liquid refrigerant has dissolved into the lubricant oil with the minimum amount required to lubricate the inside of the compressor 3.

Incidentally, during the winter when the outdoor air temperature is lower than the indoor temperature, as above-mentioned, since a pressure difference occurs in the refrigerant circuit, liquid refrigerant may stagnate in the outdoor unit 1. Liquid refrigerant is liable to stagnate mainly in the compressor 3 and the outdoor heat exchanger 5. Typically, while the outdoor air temperature continues to fall, the outdoor heat exchanger 5 is the most low temperature portion in the refrigerant circuit since the heat capacity of the compressor 3 is greater than that of the outdoor heat exchanger 5. Accordingly, it is considered that a large amount of refrigerant will stagnate in the outdoor heat exchanger 5. However, when the once falling outdoor air temperature starts to rise again, the temperature of the outdoor heat exchanger 5 rises relatively quickly causing a time lag until the temperature of the compressor 3 rises. During the above, since the compressor 3 becomes the most low temperature portion in the refrigerant circuit, a large amount of condensed refrigerant may, therefore, stagnate in the compressor 3. Due to the above, the liquid-level and concentration detection sensor 8 detects the liquid surface level of the stagnating refrigerant and the concentration of the lubricant oil in the liquid refrigerant in the compressor 3.

The detection of concentration with the liquid-level and concentration detection sensor 8 can be carried out such that the concentration of the lubricant oil in the liquid refrigerant is detected by, for example, measuring the dielectric constant of the liquid. In this case, the correlation between the concentration of the mixed liquid, which is a mixture of the refrigerant and the lubricant oil, and its dielectric constant needs to be measured in advance.

Further, in detecting the rise of the liquid surface with the liquid-level and concentration detection sensor 8, the difference of the dielectric constant between gas and liquid can be used, for example. Specifically, when the detection value of the liquid-level and concentration detection sensor 8 changes, due to the rise of the liquid surface, from the dielectric constant of gas to the dielectric constant of liquid, it can be detected that the liquid surface level in the compressor 3 has exceeded the liquid surface level that can obtain the minimum required concentration. The detection of the rise of the liquid surface with the liquid-level and concentration detection sensor 8 may be alternatively carried out by, configured as the liquid-level and concentration detection sensor, a floating level switch that is equipped in a single housing along with a sensor that carries out detection of concentration, for example.

The outdoor unit 1 is further provided with an outdoor air temperature sensor 10 that detects the outdoor air temperature and a compressor temperature sensor 11 that detects the temperature of the outer wall of the compressor 3. The detection signal of each of the liquid-level and concentration detection sensor 8, outdoor air temperature sensor 10, and the compressor temperature sensor 11 is sent to the controller 100.

Subsequently, an operation will be described.

Figure 3:
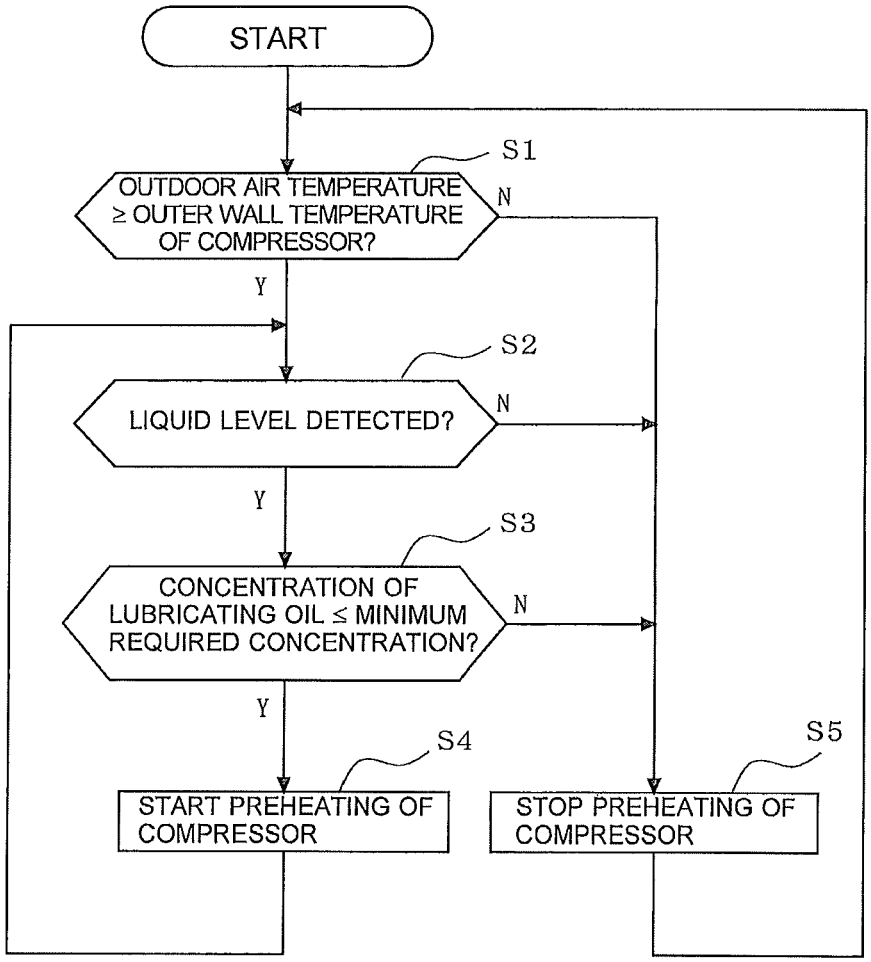
FIG. 3 is a flowchart illustrating an operation according to an embodiment of the disclosure in which a preheating to a compressor is carried out.

FIG. 3 is a flowchart illustrating an operation according to an embodiment of the disclosure in which a preheating to a compressor is carried out.

The controller 100 monitors each of the detection value of the outdoor air temperature sensor 10 and the compressor temperature sensor 11 when the air-conditioning apparatus is in a suspended state. When a detection value of the outdoor air temperature sensor 10 is lower than the detection value of the compressor temperature sensor 11 (outdoor air temperature<compressor temperature) (S1), then the controller 100 determines that it is not in a state in which the refrigerant stagnates in the compressor 3, keeps the preheating to the compressor 3 suspended (S5), and returns to step S1 and continues monitoring the outdoor air temperature and the compressor temperature. On the other hand, when a detection value of the outdoor air temperature sensor 10 is higher than or equal to the detection value of the compressor temperature sensor 11 (outdoor air temperature≥compressor temperature) (S1), then the controller 100 determines that it is in a state in which the refrigerant stagnates in the compressor 3 and, subsequently, checks the liquid surface level based on the detection value of the liquid-level and concentration detection sensor 8 (S2).

Based on the detection value of the liquid-level and concentration detection sensor 8, when the controller 100 determines that the liquid-level and concentration detection sensor 8 has not detected the liquid surface, the controller determines that the amount of the actual stagnation is not much even if it is in a state in which the refrigerant stagnates in the compressor, keeps the preheating to the compressor in a suspended state (S5), and again returns to step S1. On the other hand, based on the detection value of the liquid-level and concentration detection sensor 8, when the controller 100 determines that the liquid-level and concentration detection sensor 8 has detected the liquid surface, the controller calculates the concentration of the lubricant oil by measuring the dielectric constant of the refrigerant in the compressor 3 based on the detection value of the liquid-level and concentration detection sensor 8.

When the calculated concentration of the lubricant oil is higher than or equal to the preset minimum required concentration (detection value≥minimum required concentration) (S3), the controller 100 determines that a lubricant oil with sufficiently high concentration is present in the compressor 3, keeps the preheating to the compressor in a suspended state (S5), and again returns to step S1. On the other hand, when the calculated concentration of the lubricant oil is lower than the preset minimum required concentration (detection value<minimum required concentration) (S3), the controller 100 determines that a large amount of lubricant oil is stagnating in the compressor 3 and that the concentration of the lubricant oil is low, and starts the preheating to the compressor 3 by turning on the electric heater 3*a* (S4). Then, until the liquid-level and concentration detection sensor 8 does not detect the liquid surface, the heating state is maintained, and when the liquid-level and concentration detection sensor 8 does not detect the liquid surface, the preheating to the compressor 3 is suspended (S5), and again the process is returned to step S1. Additionally, even when the liquid-level and concentration detection sensor 8 is detecting the liquid surface, if the concentration of the lubricant oil becomes higher than or equal to the minimum required concentration, the preheating to the compressor 3 is also stopped (S5), and again the process is returned to step S1. It should be noted that the heating amount of the compressor 3 may be changed based on the liquid surface level or the concentration of the lubricant oil, or ON/OFF may be repeated in steps.

According to the above embodiment, the preheating is carried out when the environmental condition is such that refrigerant stagnates in the compressor 3, and further when the actual level of the liquid surface of the stagnating liquid in the compressor is higher than or equal to a predetermined level and the concentration of the lubricant oil in the liquid is lower than the predetermined minimum required concentration. Accordingly, the preheating can be carried out only when the inside of the compressor 3 is in a state in which preheating is actually required. Hence, unneeded preheating when the liquid surface is high while the lubricant oil has sufficient concentration can be eliminated and energy consumption can be reduced to the extent possible.

It should be noted that since the inside of the compressor 3 becomes most high in pressure in the refrigerant circuit, viewed from the reliability of the compressor 3 such as its air tightness and its pressure tightness and from the cost, when mounting a sensor to the compressor 3, it is preferable that the sensor is mounted on a single location rather than to plural locations. Since the embodiment mounts the liquid-level and concentration detection sensor 8 to a single location in the compressor 3, it is effective in terms of reliability and cost.

Further, while in an environmental condition in which the outdoor air temperature is lower than the compressor temperature and the refrigerant will not stagnate in the compressor 3, the preheating to the compressor 3 is kept in a suspended state. Furthermore, even while in an environmental condition in which the outdoor air temperature is higher than or equal to the compressor temperature and the refrigerant will stagnate in the compressor 3, when the liquid surface is under a predetermined level, the preheating to the compressor 3 is also kept in a suspended state. Accordingly, a situation in which preheating to the compressor 3 is carried out even when there is not much refrigerant stagnating in the compressor 3 can be prevented, and power consumption can be reduced.

Furthermore, even while in an environmental condition in which the outdoor air temperature is higher than or equal to the compressor temperature and the refrigerant will stagnate in the compressor 3 and while the liquid surface of the compressor raises to a higher level than or an equal level to a predetermined level, if the concentration of the lubricant oil is lower than a minimum required concentration, the preheating to the compressor is kept in a suspended state. Accordingly, a situation can be prevented in which preheating to the compressor 3 is carried out based on the determination of a stagnation of the refrigerant with only the liquid surface level in the compressor 3, even when there is a sufficient amount of high-concentration lubricant oil remaining in the compressor 3 can be prevented.

REFERENCE SIGNS LIST

1. outdoor unit, 2. indoor unit, 3. compressor, 4. four-way valve, 5. outdoor heat exchanger, 6. expansion valve, 7. indoor heat exchanger, 8. liquid-level and concentration detection sensor (liquid-level and concentration detection device), 10. outdoor air temperature sensor (outdoor air temperature detection device), 11. compressor temperature sensor (compressor-outer-wall temperature detection device), 100. controller.

The invention claimed is:

1. An air-conditioning apparatus, comprising:

an outdoor air temperature detection device detecting an outdoor temperature;

a compressor-outer-wall temperature detection device detecting a temperature of a compressor outer-wall;

a liquid-level and concentration detection device detecting a liquid surface level in a compressor and a concentration of lubricant oil in a liquid in the compressor;

a heating device heating the compressor; and a controller that carries out preheating to the compressor by driving the heating device when a condition exists wherein a detection value of the outdoor air temperature detection device is higher than or equal to a detection value of the compressor-outer-wall temperature detection device, the liquid surface level detected by the liquid-level and concentration detection device is higher than or equal to a predetermined level, and the detected concentration of the lubricant oil in the liquid in the compressor is lower than a preset minimum required concentration.

2. The air-conditioning apparatus of claim 1, wherein the liquid-level and concentration detection device is mounted on a single location in an inside of the compressor.

3. The air-conditioning apparatus of claim 1, wherein the controller allows the preheating to the compressor to be in a suspended state when the detection value of the outdoor air temperature detection device is lower than the detection value of the compressor-outer-wall temperature detection device.

4. The air-conditioning apparatus of claim 1, wherein the controller allows the preheating to the compressor to be in a suspended state when the controller detects with the liquid-level and concentration detection device that the liquid surface level is lower than a predetermined level, even when the detection value of the outdoor air temperature detection device is higher than or equal to the detection value of the compressor-outer-wall temperature detection device.

5. The air-conditioning apparatus of claim 1, wherein the controller allows the preheating to the compressor to be in a suspended state when the controller detects with the liquid-level and concentration detection device that the concentration of the lubricant oil is higher than or equal to the minimum required concentration, even when the detection value of the outdoor air temperature detection device is higher than or equal to the detection value of the compressor-outer-wall temperature detection device and even when the liquid surface level detected by the liquid-level and concentration detection device rises higher than or equal to a predetermined level.

6. The air-conditioning apparatus of claim 1, wherein after the start of the preheating, the controller suspends the preheating to the compressor when the controller detects with the liquid-level and concentration detection device that the liquid surface level declines below a predetermined level, or when the concentration of the lubricant oil detected by the liquid-level and concentration detection device is higher than or equal to the minimum required concentration even when the liquid surface level detected by the liquid-level and concentration detection device has risen higher than or equal to the predetermined level.

7. The air-conditioning apparatus of claim 1, wherein the liquid-level and concentration detection device detects the concentration of the lubricant oil based on a measuring result obtained by measuring a dielectric constant of the liquid in the compressor.

8. The air-conditioning apparatus of claim 1, wherein the liquid-level and concentration detection device is mounted at a level where a minimum required concentration can be obtained even when the liquid refrigerant has dissolved into the lubricant oil with the minimum amount required to lubricate the inside of the compressor.

9. The air-conditioning apparatus of claim 1, wherein the liquid-level and concentration detection device is a floating level switch along with a sensor that carries out detection of the concentration of the lubricant oil.

* * * * *